US008317641B1

(12) United States Patent
Lowinger et al.

(10) Patent No.: US 8,317,641 B1
(45) Date of Patent: Nov. 27, 2012

(54) FOOTBALL LACING SYSTEM

(75) Inventors: Daniel J Lowinger, Cranston, RI (US); Charles T Quinn, Dover, MA (US)

(73) Assignee: Franklin Sports, Inc, Stoughton, MA (US)

( * ) Notice: Subject to any disclaimer, the term of this patent is extended or adjusted under 35 U.S.C. 154(b) by 189 days.

(21) Appl. No.: 12/891,060

(22) Filed: Sep. 27, 2010

(51) Int. Cl.
*A63B 43/02* (2006.01)
*A63B 41/08* (2006.01)

(52) U.S. Cl. ..... 473/597

(58) Field of Classification Search ..... 473/596, 473/597, 598, 599, 603, 608
See application file for complete search history.

(56) References Cited

U.S. PATENT DOCUMENTS 2,182,053 A * 12/1939 Reach ..... 473/597
2,874,965 A * 2/1959 Martin ..... 473/597
4,869,504 A * 9/1989 Kralik ..... 473/597
4,928,962 A 5/1990 Finley
5,098,097 A 3/1992 Kennedy et al.
5,127,648 A 7/1992 Mallick
5,383,660 A * 1/1995 Adler et al. ..... 473/596
5,570,882 A * 11/1996 Horkan ..... 473/573
5,941,785 A 8/1999 Bartels
6,514,164 B1 2/2003 Parrett
7,470,203 B1 * 12/2008 Stillinger ..... 473/596
2003/0195068 A1 * 10/2003 Murphy et al. ..... 473/596

* cited by examiner

*Primary Examiner* — Steven Wong

(74) *Attorney, Agent, or Firm* — Joseph B Bowman

(57) ABSTRACT

A football lacing system having a molded backbone with a series of spaced finger grooves separated by resilient ridges to insure proper hand placement for throwing a spiral pass. The backbone is preferably molded of thermal plastic rubber and is secured over the bladder seam of the exterior football covering by lacing that extends between paired lace holes along the length of the bladder seam.

18 Claims, 4 Drawing Sheets

FOOTBALL LACING SYSTEM

CROSS-REFERENCE TO RELATED APPLICATIONS

This application has no related applications.

STATEMENT REGARDING FEDERALLY SPONSORED RESEARCH OR DEVELOPMENT

The inventions described and claimed in this application were not made under federally sponsored research and development.

BACKGROUND OF THE INVENTION

This invention relates to an improved football lacing system. More specifically, this invention relates to a lacing system for closing the bladder seam of a football and for providing improved grip to throw an effective spiral pass.

The proper gripping of a football for the purpose of throwing a spiral pass is particularly problematic for youngsters. A wide variety of alternatives have been proposed in the past for improving the grip on a football. For example, U.S. Pat. Nos. 4,928,962 of Finley and 6,514,164 of Parrett are directed to improvements in the tactile surface of the material for constructing the football in order to enhance the user's grip. U.S. Pat. No. 5,098,097 of Kennedy et al proposes a counter weight diametrically opposed to the conventional lacing in order to better balance the football for improved spiral passes. U.S. Pat. No. 5,570,882 of Horkan provides a Velcro lacing system with a corresponding Velcro fingered glove in order to improve the user's grip and to impart a proper spin to the football. U.S. Pat. No. 5,941,785 of Bartels simply repeats the lacing pattern numerous times around the football so the user does not have to rotate the ball as much in order to place the fingers of the throwing hand on a set of the football laces.

U.S. Pat. No. 5,127,648 of Mallick provides a recess in the exterior surface of the football, apart from the conventional laces, so the user can better grip the ball at the recessed region. A similar technique is found in U.S. Pat. No. 5,383,660 of Adler et al which provides for individual finger recesses for grip improvement. However, the latter patent is directed to a molded football as opposed to a conventional bladder-containing football.

U.S. Pat. No. 4,869,504 of Kralik teaches a molded plastic lacing assembly mated to a corresponding fastener plate that totally replaces conventional laces. The purpose of Kralik is not to improve grip or tactile stimulus, but to provide a faster and economic manufacturing alternative to the tedious and time consuming process of hand lacing.

Therefore, a need remains in the field of youth sports for a football lacing system applied to a traditional bladder-containing football to improve grip and to enhance the throwing of a spiral pass. The primary objective of this invention is to meet this need.

SUMMARY OF THE INVENTION

More specifically, an object of the invention is to provide a football lacing system to permit a youngster to learn the proper mechanics of throwing a spiral pass with a football and to consistently deliver spiral passes with confidence and efficiency.

Another object of the invention is to provide a football lacing system with a grip enhancing features to permit repeated hand placement to insure the proper grip of the ball for delivering a spiral pass.

A further object of the invention is to provide a football lacing system of the character described wherein the grip enhancing features thereof include tactile stimulus for securing a positive hand placement.

In summary, an object of the invention is to provide football lacing system having a molded backbone comprising a series of spaced finger grooves separated by resilient ridges to insure proper hand placement for throwing a spiral pass. The backbone is preferably molded of thermal plastic rubber and is secured over the bladder seam of the exterior football covering by lacing that extends between paired lace holes along the length of the bladder seam.

Other and further objects of the invention, together with the features of novelty appurtenant thereto, will appear in the course of the detailed description of the drawings.

BRIEF DESCRIPTION OF THE DRAWINGS

In the following description of the drawings, in which like reference numerals are employed to indicate like parts in the various views.

DETAILED DESCRIPTION OF THE DRAWINGS

Figure 1:
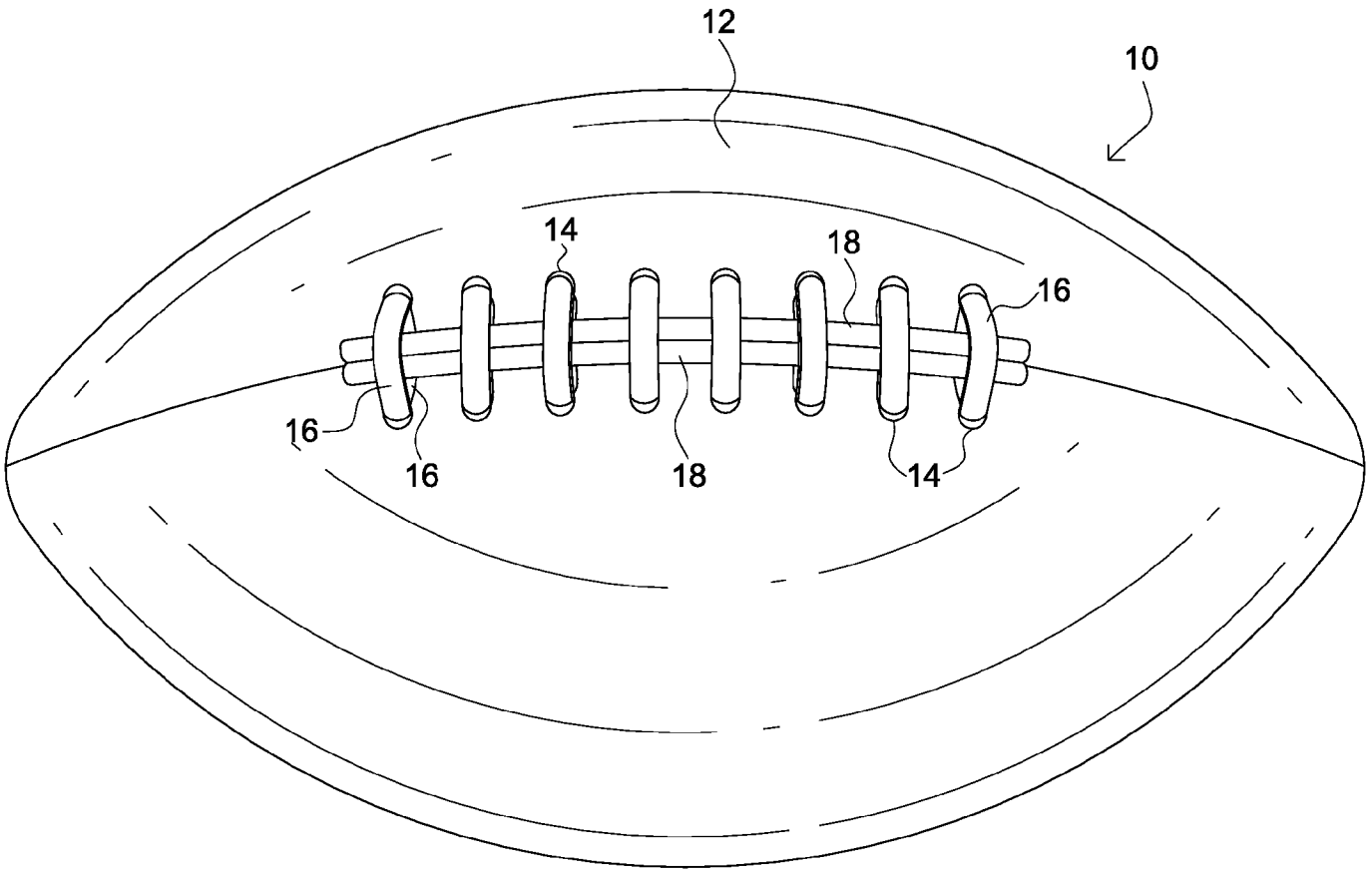
FIG. 1 PRIOR ART
FIG. 1 is a perspective view of a football with a bladder seam closed with traditional lacing.
Figure 2:
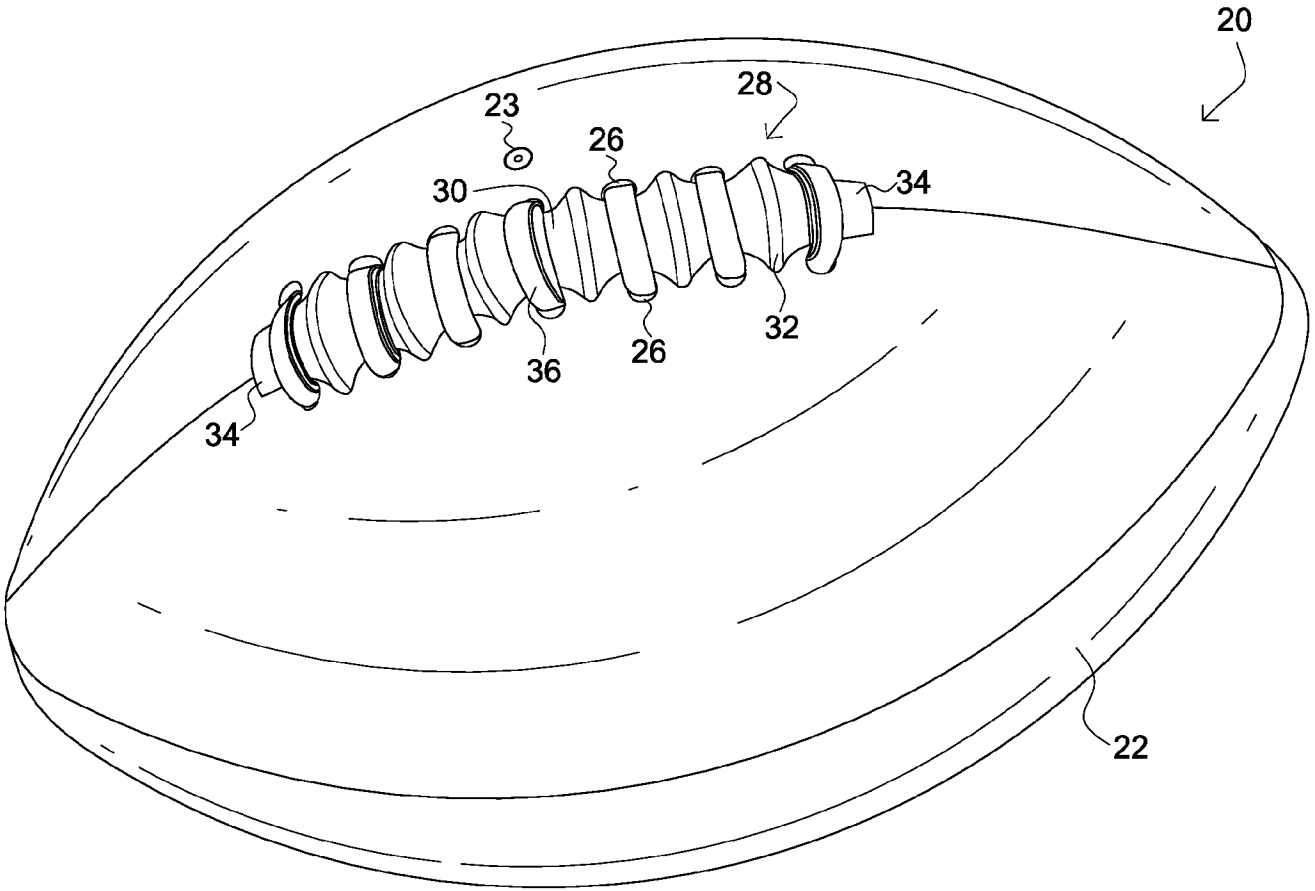
FIG. 2 is a perspective view of a football with a bladder seam closed with a lacing system embodying the invention.
Figure 3:
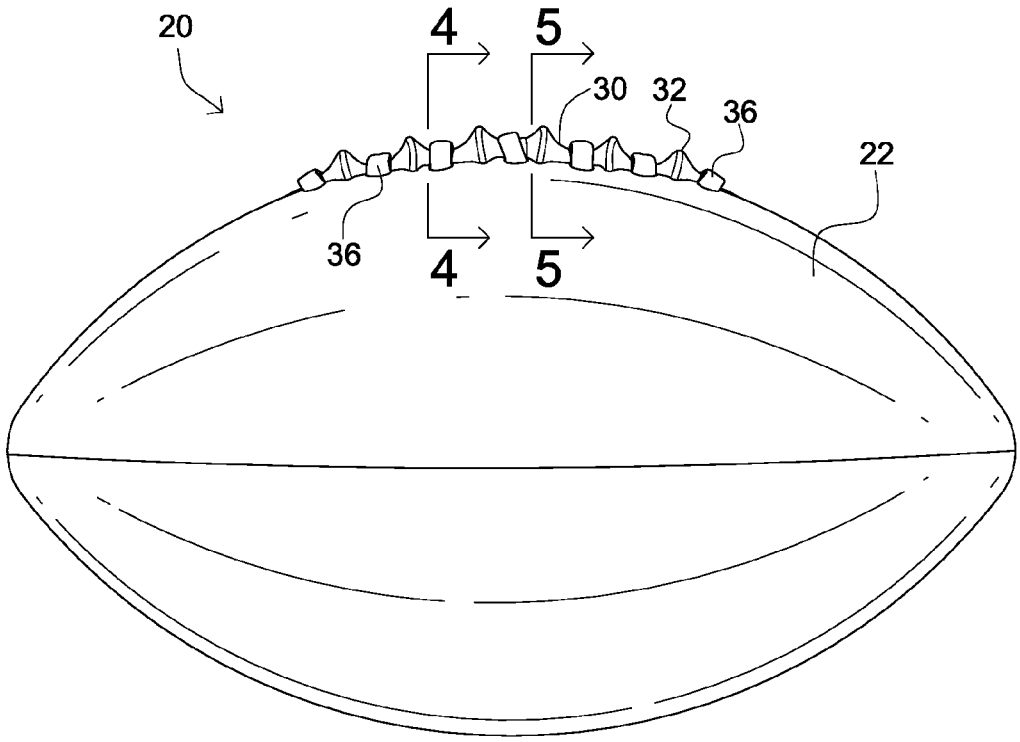
FIG. 3 is a side elevational view of a football with a bladder seam closed with a lacing system embodying the invention.

Referring to the drawings in greater detail, attention is first focused on the prior art illustration of FIG. 1 which shows traditional football lacing. The football 10 contains an inflatable bladder (not shown) within a synthetic or natural leather covering 12. Evenly spaced along opposite sides of the bladder seam (not shown) are paired lace holes 14. The lace holes 14 receive lateral lacing loops 16 threaded through each set of opposed pairs of lace holes 14 in order to close the bladder seam of the outer covering 12. The lateral lacing loops 16 are typically doubled so that two strands of lacing are threaded through each set of opposed pairs of lace holes 14. Two longitudinal strips 18 of lacing run side by side the length of the bladder seam between the paired lace holes 14. The longitudinal lacing strips 18 may pass under both of the double strands of the lateral lacing loops 16 or, as illustrated in FIG. 1, the longitudinal lacing strips 18 may be threaded between the double strands of the lateral lacing loops 16 such that the lowermost strand of lateral loop 16 underlies the longitudinal strips 18 and the uppermost strand of lateral loop 16 overlies the longitudinal strips 18. Depending upon the thickness and strength of the lacing material, sometimes only a single strand of lacing may be employed for the lateral lacing loops 16.

Figure 4:
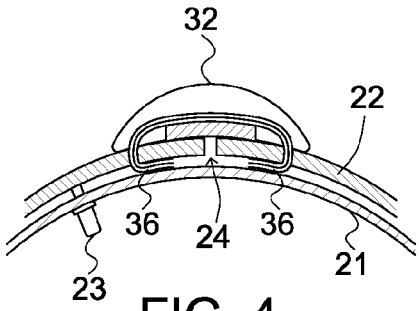
FIG. 4 is an enlarged, fragmentary sectional view taken along line 4-4 of FIG. 3 in the direction of the arrows.
Figure 5:
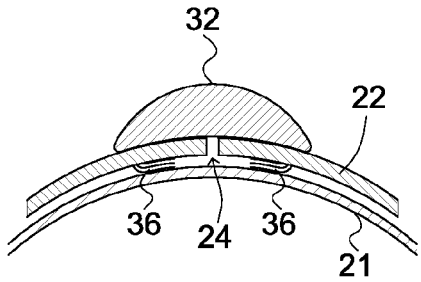
FIG. 5 is an enlarged, fragmentary sectional view taken along line 5-5 of FIG. 3 in the direction of the arrows.
Figure 6:
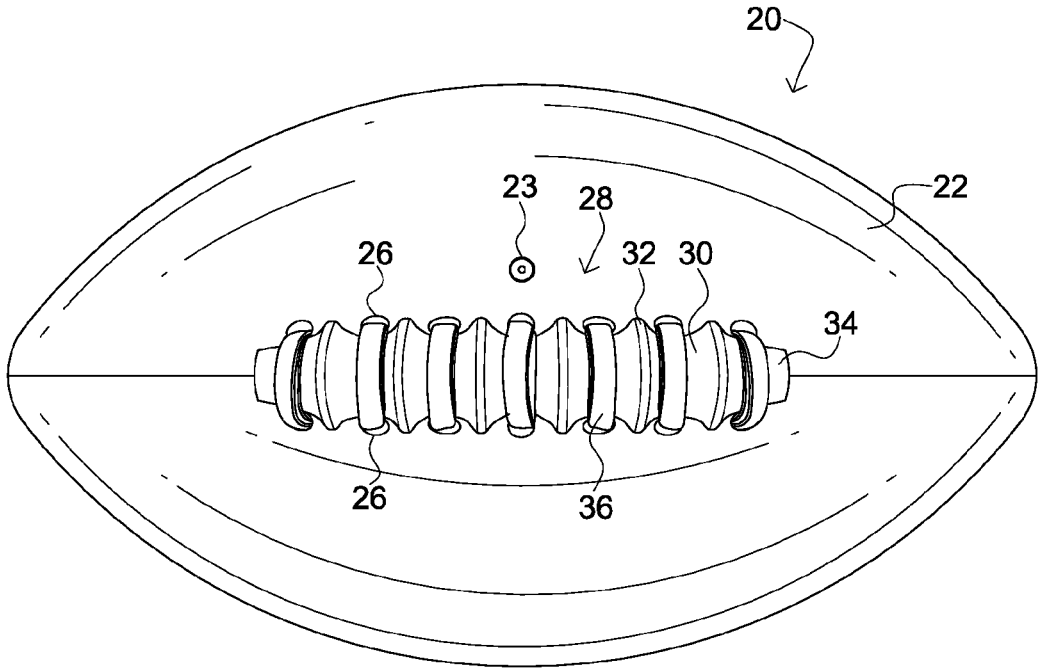
FIG. 6 is a top plan view of the football illustrated in FIG. 3.

As illustrated in the remaining views of the drawings, the football 20 of this invention contains a traditional inflatable bladder 21 within a synthetic or natural leather covering 22. A fill valve 23 that extends through the covering 22 may be used to inflate the bladder 21 by means of an air source and a conventional needle inflation fitting (not shown). Evenly spaced along opposite sides of the bladder seam 24 (FIGS. 4 & 5) are paired lace holes 26.

Figure 7:
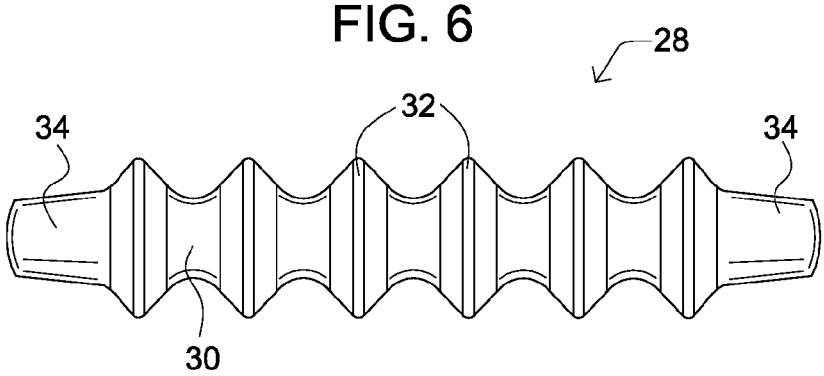
FIG. 7 is an enlarged top plan view of the backbone component of the football lacing system.
Figure 8:
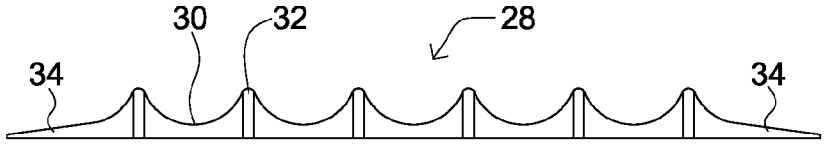
FIG. 8 is a side elevational view of the backbone component as illustrated in FIG. 7.

Overlying the bladder seam 24 along the entire length thereof is a backbone 28 illustrated in its pre-installation form in FIGS. 7 & 8. The backbone 28 comprises a series of finger grooves 30 evenly spaced along the length of the backbone 28 and separated by upwardly projecting ridges 32. The finger grooves 30 are arcuately shaped, preferably with a common radius of curvature as shown in FIG. 8, in order to generally correspond to the rounded shape of the finger on a human hand. The lowest region of the finger grooves 30 extend in height above the football covering 22 at least the thickness of the lacing to be used. A football 20 sized for a youthful hand may be constructed with finger grooves 30 correspondingly smaller than those intended for an adult.

The ridges 32 of the backbone 28 extend well above the lowest region of the finger grooves 30 such that the height of the ridges 32 may represent approximately half the thickness of a human finger. In relation to the other components of construction, the ridges 32 should extend in height at least about six times the thickness of the lacing to be used. Once again, however, the dimensions of the ridges 32 may be appropriately sized to accommodate youthful hands as necessary.

The terminal ends 34 of the backbone 28 gradually taper from the outermost ridges 32 to the football covering 22.

The backbone 28 is preferably molded from material having some resiliency and also having a tactile quality. Suitable molding material has been found to be thermal plastic rubber (TPR) for fabrication of the backbone 28.

The backbone 28 is positioned on the football 20 such that the finger grooves 30 are aligned between the paired lace holes 26. Lacing loops 36 extend between the opposed holes of each paired set of lace holes 26 and overlie the finger grooves 30 and the terminal ends 34 in order to bind the backbone 28 to the exterior surface of the football covering 22 and to thus hold together and cover the bladder seam 24. As illustrated in the views of the drawings, the lacing loops 36 are doubled so that two strands overlie each of the finger grooves 30 and the terminal ends 34. However, the lacing loops 36 may comprise a single strand depending upon the thickness and strength of the lacing material selected.

With the football 20 constructed as described, the fingers on the user's hand may rest comfortably within the finger grooves 30 separated by the ridges 32. Portions of the fingers will necessarily contact the resilient, tactile surface of portions of the finger grooves 30 adjacent the ridges 32 of the backbone 28. This provides a superior grip which, coupled with the increased height of the gripping structure provided by the finger grooves 30 with the associated lacing loops 36, permits the user to more quickly learn the mechanics of a spiral pass and to throw spiral passes with confidence and efficiency.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

Having thus described our invention, we claim:

1. A football lacing system for a football having a bladder, a cover with a bladder seam, and a plurality of paired lacing holes spaced along opposite sides of said seam, said lacing system comprising:

a backbone member to overlie said football bladder seam, said backbone member having finger grooves spaced along the length thereof in registry with said paired lacing holes and also having ridges spaced along the length thereof between said finger grooves and projecting in height above said finger grooves; and closure laces extending between said paired lacing holes to overlie said finger grooves of said backbone member;

whereby said laces secure said backbone member to the football and close said bladder seam while said ridges provide finger separation along said backbone to improve gripping of the football.

2. The football lacing system as in claim 1, said closure laces having a width less than the diameter of said lacing holes in order to pass therethrough and having a thickness T.

3. The football lacing system as in claim 2, said finger grooves of said backbone member having a maximum height of at least the thickness T of said closure laces.

4. The football lacing system as in claim 3, said ridges of said backbone member having a maximum height of at least six times the thickness T of said closure laces.

5. The football lacing system as in claim 3, said finger grooves of said backbone member being uniformly arcuate along the longitudinal length thereof and being sized such that the side contours of said ridges provide contact with the user's fingers when gripping the football.

6. The football lacing system as in claim 1, said finger grooves of said backbone member having a minimum lateral width less than the lateral distance between said paired lacing holes.

7. The football lacing system as in claim 6, said ridges of said backbone member having a maximum lateral width greater than the lateral width of said finger grooves.

8. The football lacing system as in claim 7, said ridges of said backbone member having a maximum lateral width equal to or greater than the lateral distance between said paired lacing holes.

9. The football lacing system as in claim 1, said backbone member being molded of thermal plastic rubber to facilitate tactile contact with the user's fingers.

10. A football lacing system for a football having a bladder, a cover with a bladder seam, and a plurality of N pairs of lacing holes uniformly spaced apart and uniformly spaced along opposite sides of said seam, said lacing system comprising:

a backbone member to overlie said football bladder seam, said backbone member having N finger grooves spaced along the length thereof in registry with said N pairs of lacing holes and also having N−1 ridges spaced along the length thereof between said N finger grooves and projecting in height above said finger grooves; and closure laces extending between said pairs of lacing holes to overlie said finger grooves of said backbone member;

whereby said laces secure said backbone member to the football and close said bladder seam while said ridges provide finger separation along said backbone to improve gripping of the football.

11. The football lacing system as in claim 10, said closure laces having a width less than the diameter of said lacing holes in order to pass therethrough and having a thickness T.

12. The football lacing system as in claim 11, said finger grooves of said backbone member having a maximum height of at least the thickness T of said closure laces.

13. The football lacing system as in claim 12, said ridges of said backbone member having a maximum height of at least six times the thickness T of said closure laces.

14. The football lacing system as in claim 12, said finger grooves of said backbone member being uniformly arcuate along the longitudinal length thereof and being sized such that the side contours of said ridges provide contact with the user's fingers when gripping the football.

15. The football lacing system as in claim 10, said finger grooves of said backbone member having a minimum lateral width less than the uniform lateral distance between any said pair of lacing holes.

16. The football lacing system as in claim 15, said ridges of said backbone member having a maximum lateral width greater than the lateral width of said finger grooves.

17. The football lacing system as in claim 16, said ridges of said backbone member having a maximum lateral width equal to or greater than the uniform lateral distance between any said pair of lacing holes.

18. The football lacing system as in claim 10, said backbone member being molded of thermal plastic rubber to facilitate tactile contact with the user's fingers.

* * * * *